United States Patent [19]

McManus

[11] 4,295,310

[45] Oct. 20, 1981

[54] PRECAST CONCRETE JOIST COMPOSITE SYSTEM

[76] Inventor: Ira J. McManus, 39 Lincoln Ave., Florham Park, N.J. 07940

[21] Appl. No.: 68,830

[22] Filed: Aug. 22, 1979

[51] Int. Cl.[3] ..... E04B 1/16

[52] U.S. Cl. ..... 52/334

[58] Field of Search ..... 52/250, 332–334, 52/337, 340, 336, 378, 319, 327

[56] References Cited

U.S. PATENT DOCUMENTS

| | | | |
|---|---|---|---|
| 3,094,813 | 6/1963 | Saxe | 52/334 X |
| 3,392,499 | 7/1968 | McManus | 52/334 X |
| 3,527,007 | 9/1970 | McManus | 52/334 X |
| 3,566,567 | 3/1971 | Watanabe | 52/250 |
| 3,624,980 | 12/1971 | McManus | 52/334 X |
| 3,683,580 | 8/1972 | McManus | 52/334 |
| 3,728,835 | 4/1973 | McManus | 52/334 |
| 4,056,908 | 11/1977 | McManus | 52/334 |
| 4,186,535 | 2/1980 | Morton | 52/250 |
| 4,189,883 | 2/1980 | McManus | 52/250 |

*Primary Examiner*—J. Karl Bell

[57] ABSTRACT

A precast concrete joist composite system having first and second spaced apart precast concrete joist members supported at their respective ends by a support, each of said joist members having a concrete portion, said joist members having at end portions respective projecting structures that have first parts anchored in said concrete portions of their respective joist members and second parts extending from said concrete portion end faces, said end faces having respective portions thereof that slope downward and away from said concrete portions, at least a first pan disposed at said end face, a first part of said pan element being disposed over the top surfaces of said concrete portions and a second part thereof disposed over said sloping portions of said end faces, and a decking element disposed over the respective said top surfaces of said first and second joist members and spanning the space between said joist members.

41 Claims, 12 Drawing Figures

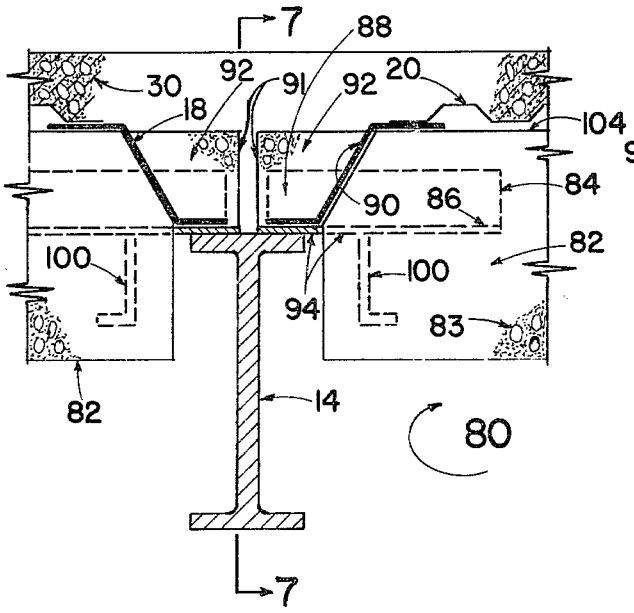
FIG. 6
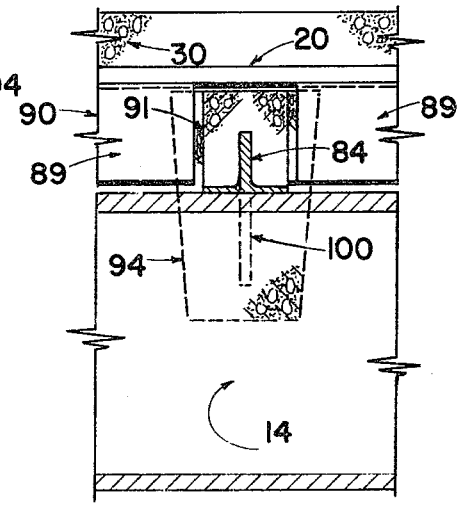
FIG. 7
FIG. 8
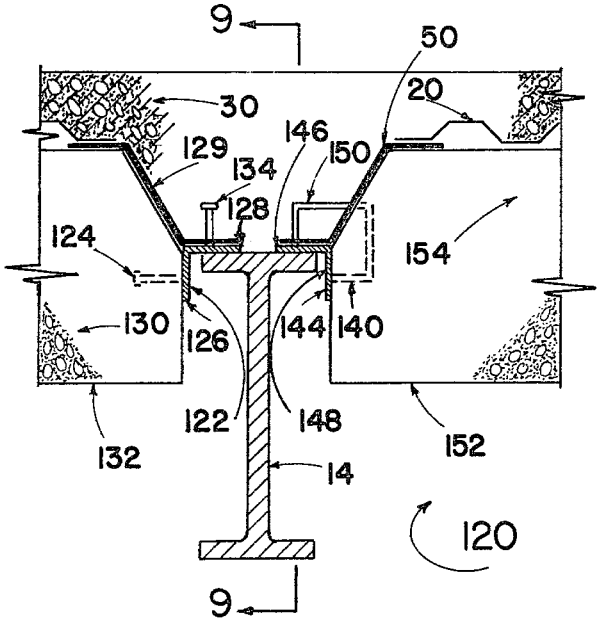
FIG. 9
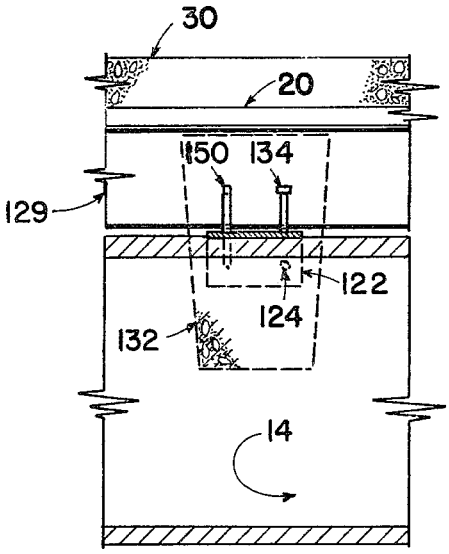

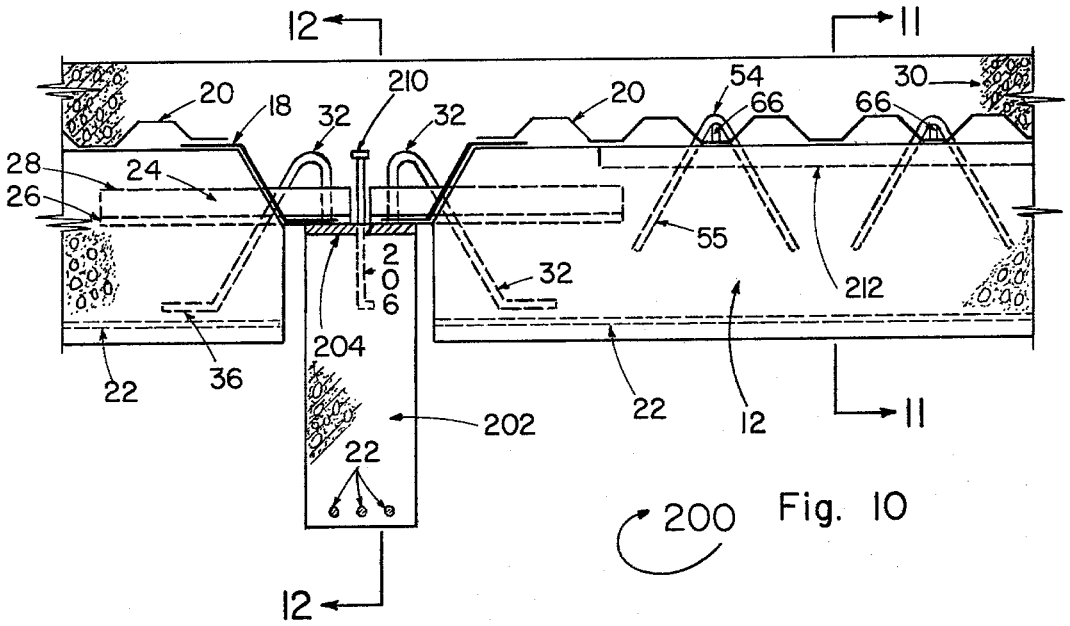
Fig. 10
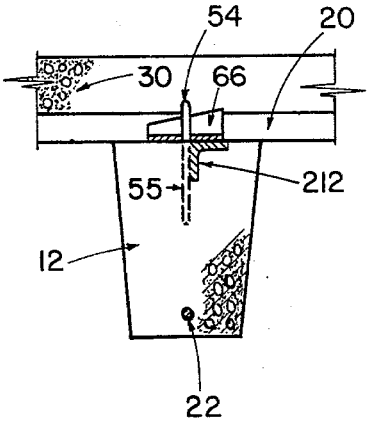
Fig. 11
Fig. 12
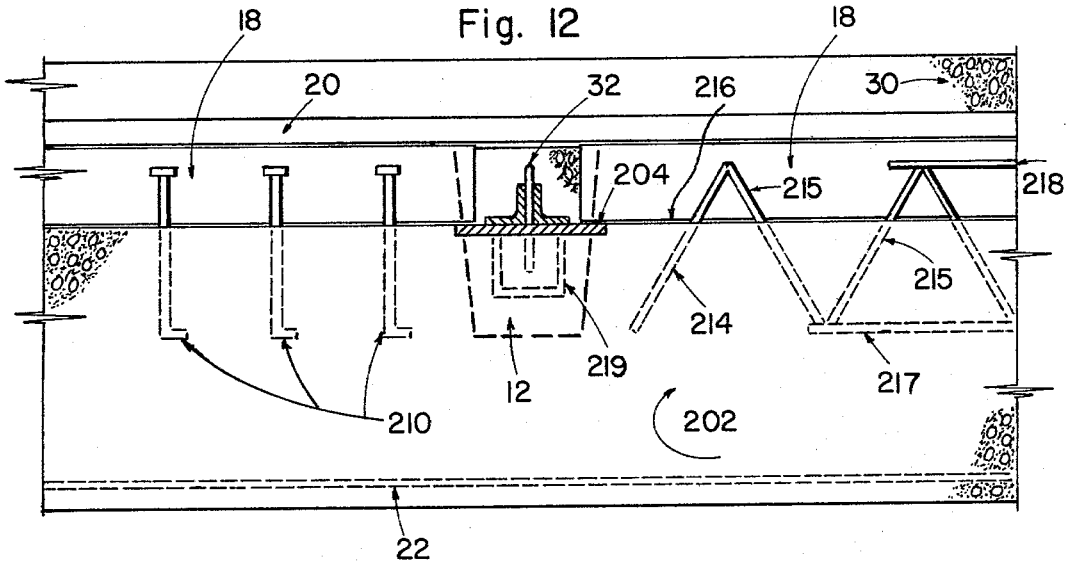

PRECAST CONCRETE JOIST COMPOSITE SYSTEM

BACKGROUND OF THE INVENTION

The present invention relates to a composite structural system, particularly to one having precast concrete joist-steel girder construction.

The prior art is familiar with steel open web joint structures, which are described in the present inventor's copending U.S. patent applications, Ser. No. 865,632 now abandoned; 491,696; and 930,950 now U.S. Pat. No. 4,189,883, and U.S. Pat. No. 3,392,499; 3,457,818; 3,527,007; 3,624,980; 3,683,580; 3,728,835; and 4,056,908.

While the steel open web joist structures of the prior art have been widely accepted and used, they are not completely desirable in many applications where it is desirable to have less maintenance of the structure and better resistance to the elements. One such application is their use in open parking structures where such open web joist structures are difficult and expensive to clean and paint. Better resistance to fire is also desired.

The present invention seeks to provide a suitable structure that overcomes, or at least alleviates, the above mentioned drawbacks, as well as providing other advantages that will become apparent from the present specification.

SUMMARY OF THE INVENTION

The present invention comprises a precast concrete joist composite system that includes support means, at least first and second spaced apart precast concrete joist members, one or more pan elements, and one or more decking elements. The concrete joist members are supported at their respective ends by the support means, which can be a beam.

Each joist member comprises a concrete portion that has a first end portion, which comprises an end face. At the end of each joist member there is a projecting structure, which can be an angle element. The projecting structure has a first part anchored in the concrete portion and a second part extending out from the end face. Each end face has an inclined part and the pan element is partly supported upon this inclined surface and partly by the top surface of the concrete portion.

The joist member preferably comprises rod members having parts that protrude above the top surface of the concrete portion and are used for securing the decking in place. The pan and decking receiving concrete that hardens to provide a slab.

BRIEF DESCRIPTION OF THE DRAWINGS

FIG. 6 is a sectional side elevation view of the composite system of the present invention, according to another prefered embodiment.

FIG. 7 is a sectional end elevation view of the embodiment of FIG. 6 along axis 7—7.

FIG. 8 is a sectional side elevation view of the composite system of the present invention, according to another preferred embodiment.

FIG. 9 is a sectional end elevation view of the embodiment of FIG. 8 along axis 9—9.

FIG. 10 is side elevation view of a portion of the precast concrete joist composite system according to a further embodiment of the invention.

FIG. 11 is a sectional elevation view of the system of FIG. 10 along axis 11—11.

FIG. 12 is a sectional elevation view of the system of FIG. 10 along axis 12—12.

PREFERRED EMBODIMENTS

Figure 1:
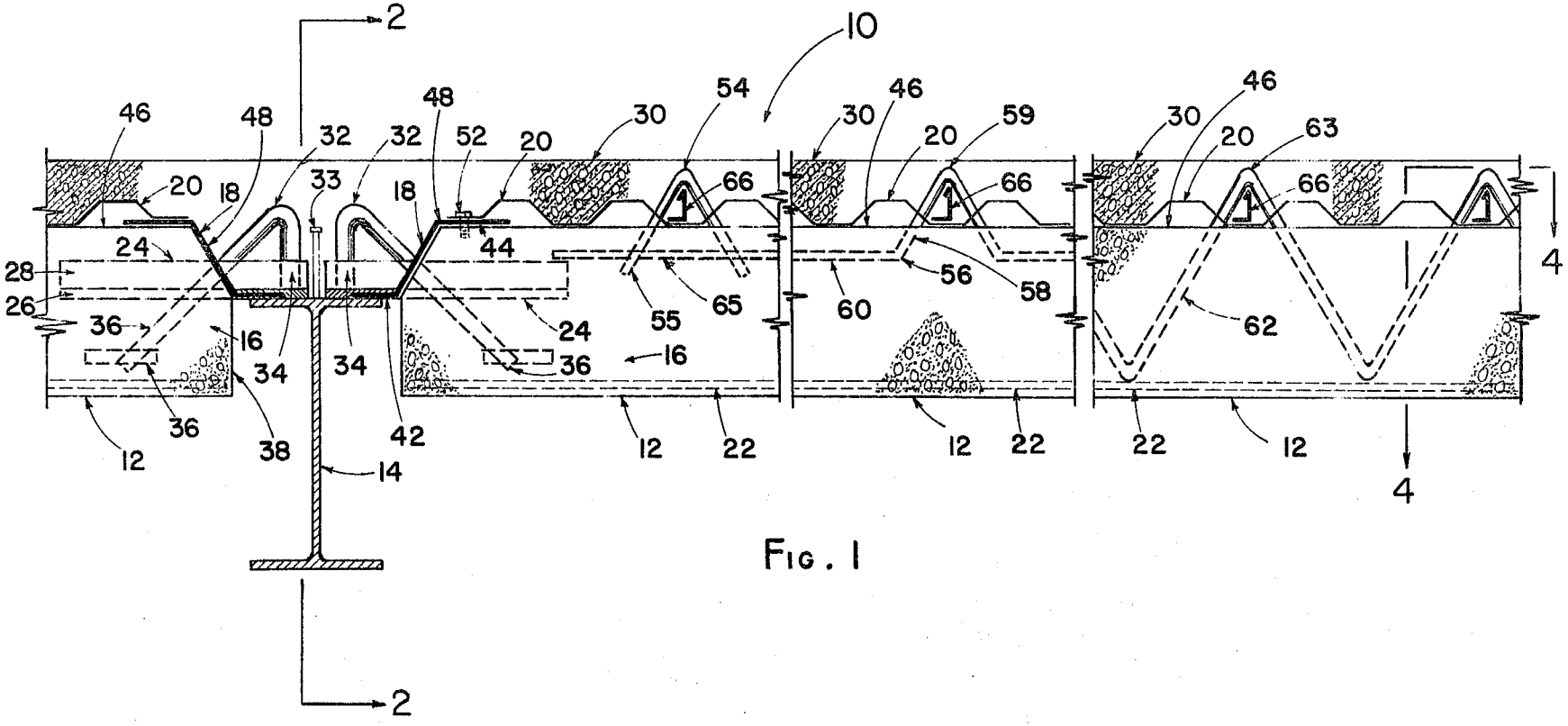
FIG. 1 is a side elevation view of the precast concrete joist composite system according to an embodiment of the present invention.

Referring to FIG. 1, the composite system 10 of the present invention comprises one or more precast concrete joists 12, support means such as a composite girder or beam 14 at which the respective ends 16 of the joist 12 are disposed, concrete pans 18 of steel or other suitable material disposed at the region between the ends 16 of the joists 12, and corrugated sheet or decking 20 disposed partly over and supported by the joists 12.

The joists are elongated and are, as stated above, preferably of precast concrete and replace the steel joist known to the prior art. It is preferred that the joists 12 of the present invention be reinforced for the expected bending stresses to which the joists 12 will be subjected in use, such reinforcement being achievable with reinforcing bars 22 or prestressing strands. At the ends 16 of the joints 12 that are to be supported by the beam, each of the joists 12 includes a pair of steel bearing angle members 24 for bearing on the supporting beam 14. The angles 24 form an integral part of the joists 12 and are disposed with their horizontal arms 26 down and their vertical arms 28 extending upward, the horizontal arms 26 being disposed on the beam 14. When the concrete slab 30 is poured in place (as explained hereinafter) the joists 12 and beam 14 will become composite with the cast-in-place slab 30.

The precast joist members 12 also include web elements 32 disposed between (and preferably welded or otherwise connected to) the vertical arms 28 of the angles 24. The web elements 32 can be generally S-shaped (as shown), generally 7-shaped, or of other suitable configuration, and are preferred to have a first end portion 34 connected to the angles 24 and the second opposite end portion 36 disposed within the concrete of the joists 12, as shown in FIG. 1.

The web elements 32 can act as a stud-type shear connector to the beam when the web elements 32 are encased in the poured-in-place concrete slab 30. Also, the web elements 32 can act as a tension member to help support the vertical load from the joist end and can reinforce the respective paired angle members to better resist upward bending stresses until the poured-inplace concrete slab hardens.

According to a preferred embodiment of the invention, the respective ends 16 of the joists 12 comprise a first lower face 38 that can be vertical and a second upper face 40 that is angularly oriented with respect to the lower face 38, the upper face sloping down toward the beam 14. The angle members 24 preferably are located such that they are located in the region of the juncture of the upper and lower faces 38, 40, with the angle members 24 projecting out from the ends 16 of the joists. The angle members 24 preferably have their major axes generally parallel to the longitudinal axis of their respective joist members 12 of which they form a part.

Where it is desired, the angle members 24 can coincide generally with the longitudinal axes of their associated joists 12 and/or the end face can be vertical along the entire length thereof, i.e., for the full depth of the joist 12, this latter embodiment (i.e., the full vertical end face) providing a haunch that is less desirable in shape than the sloped upper end face configuration shown in FIG. 1.

Figure 2:
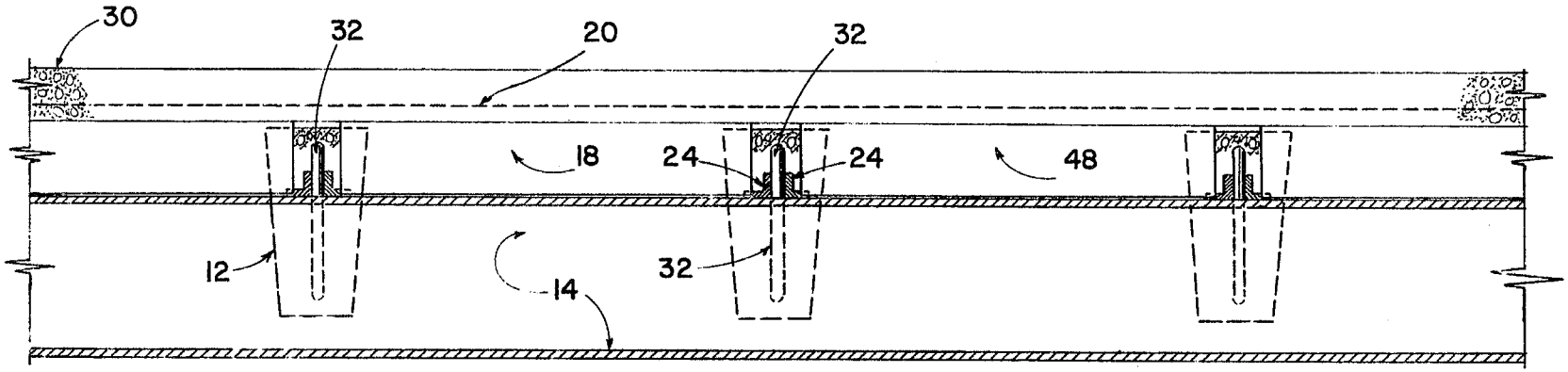
FIG. 2 and 3 are end elevation views, along axis 2—2, of alternative preferred embodiments of a portion of the composite system of FIG. 1.
Figure 3:
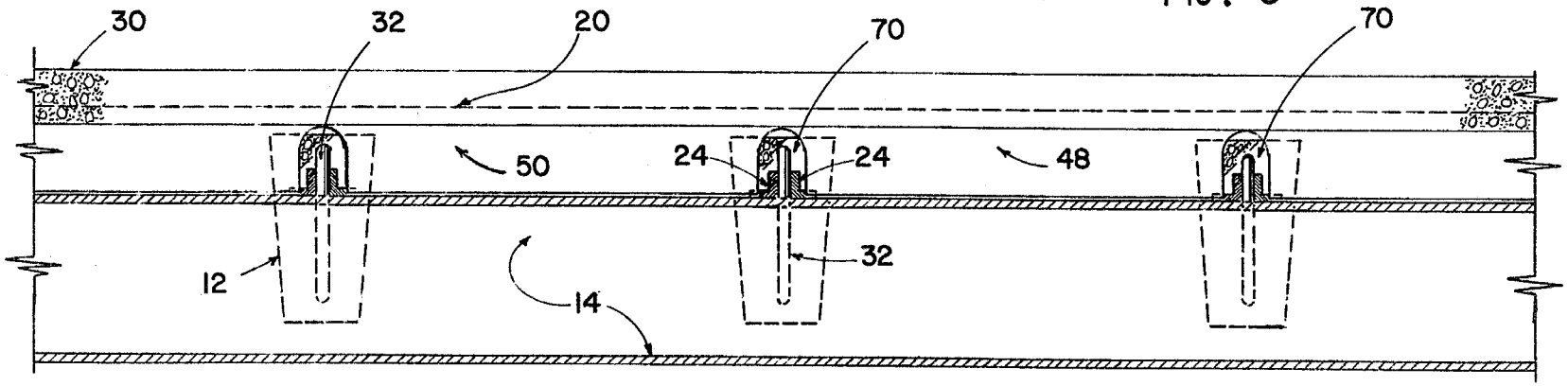

At the joining regions of the joists 12 and the beam 14 there are disposed a number of preformed sheet metal pans 18 that are of a generally S-shaped profile with first flat edges 42 disposed, preferably, at the horizontal arms 26 of the angle members 24 and extending between adjacent joists 12, as shown in FIG. 2 and 3. The opposite flat second edges 44 of the pans 18 (which can be generally parallel with the first edge portions 42) are disposed at the top surfaces 46 of the concrete portions of their associated joists 12, each pan 18 having an intermediate portion 48 between the first and second' edges 44, 46. The intermediate portion 48 of the respective pans 18 can, and preferably does, rest upon the sloping end upper faces 40 of their associated joists 12. It is preferred that the pans 18 (whose intermediate portions 48 can be obliquely disposed with respect to the first and second edge portions 44, 48) span the spaces between adjacent joists 12 at the area of the supporting girder of beam 14 and bear on the top surface and the end face of the concrete portion of the joist. The pans 18 can each be a separate segment that extends from one joist to the next joist 12, only, as shown in FIG. 2 or each pan 50 (FIG. 3) can span the distances between three or more adjacent joists so that a pan 50 straddles at least one concrete joist 12. The embodiment shown in FIG. 3 (where numerals identical to FIG. 2 show corresponding parts) is disclosed in my co-pending U.S. patent application Ser. No. 039,227, filed May 14, 1979 and titled Precast Concrete Joist System.

The pans 18, 50 have considerable "beam strength" due to the bends provided therein. Additional strength can be achieved by attaching the pans to the beams and the corrugated deck 20, as, for example, by screws 52 (FIG. 1) or other suitable means. Because the upper edges 44 of the pans 18 or 50 bear directly against the concrete surfaces 46 of the joists 12 and the angles 24, very little concrete leakage will occur.

According to a further preferred embodiment of the present invention, the joists 12 each contain one or more projecting rod members 54 that extend upward from the upper surface 46 of the joists 12, the lower extremities 55 thereof being anchored in the concrete joist. The rod members 54 can be a number of separate segments that are disposed in spaced apart relation along the length of the concrete joist 12, or, alternatively, the rod member can be a continuous element as rod member 56 (FIG. 1) having angular portions 58 that are partly disposed within the concrete joist 12 and project at their apices 59 from the top surface 46 of the joists 12. The various angular portions 58 are connected by intermediate connecting parts 60, forming a unitary structure. As a further alternative, the rods of the joists can be as depicted by that shown as 62 (FIG. 1). This is a zig-zag arrangement whose individual portions are all angularly oriented as a continuous series of W-shaped elements, with the apices 63 extending from the joist top surface 46. The rod 62 can also serve to reinforce the joists. Where the rod members 54 are separate segments, they can be joined together by a connecting rod 65, to which they are welded.

Figure 4:
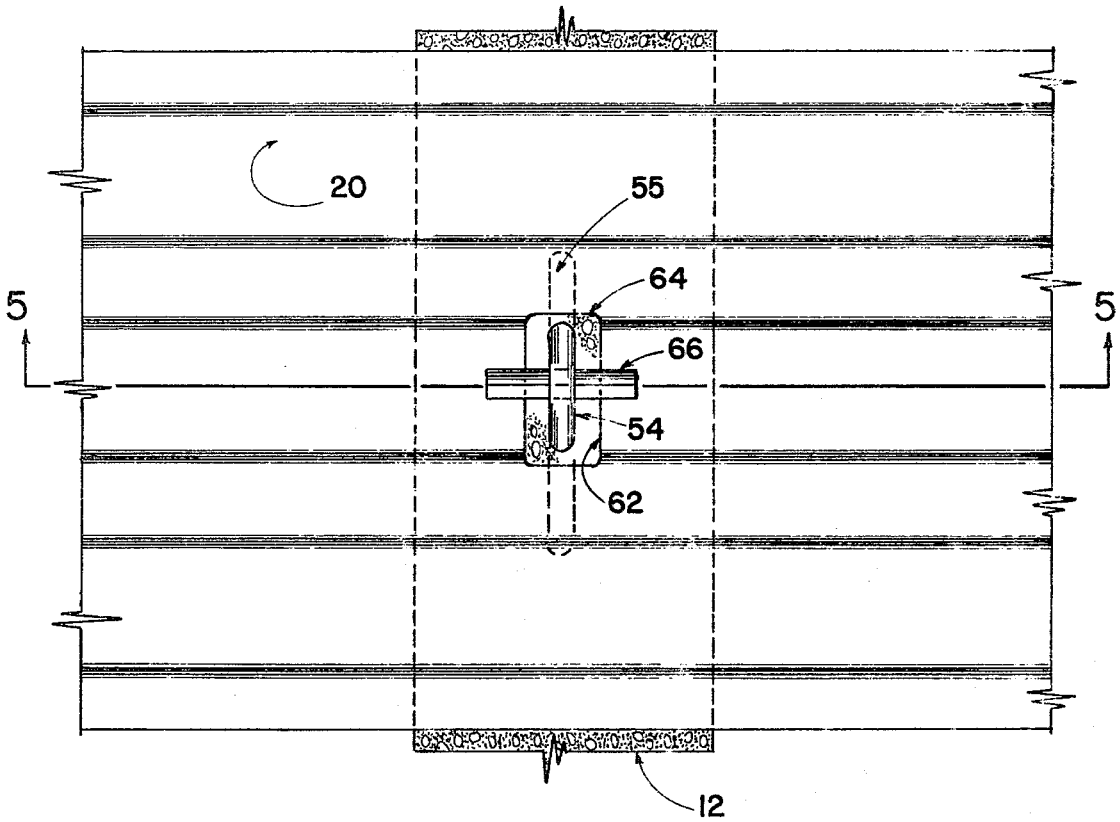
FIG. 4 is a cutaway plan view, along axis 4—4, of a portion of the composite system of FIG. 1.
Figure 5:
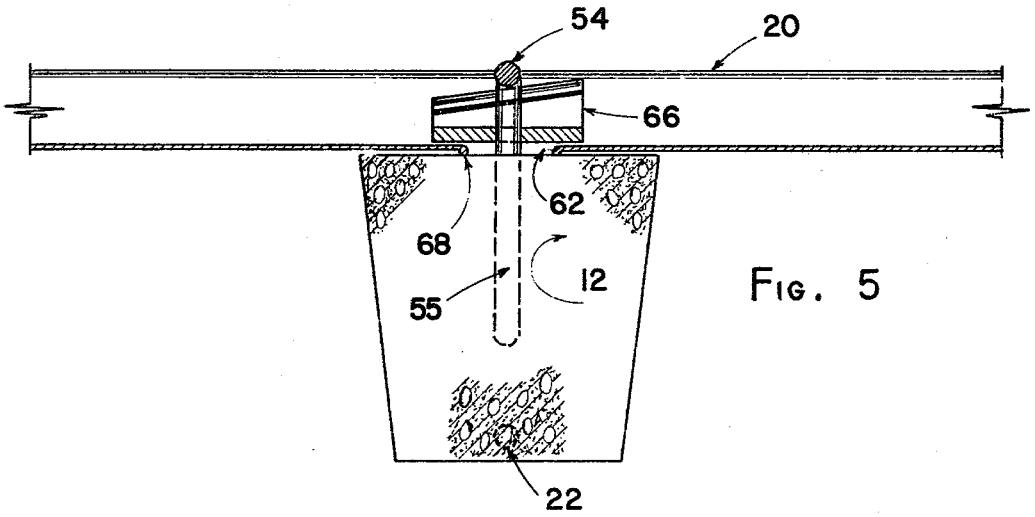
FIG. 5 is a partial sectional elevation view of the composite system of FIG. 4, along axis 5—5.

The corrugated decking 20 used with the present invention continuously spans multiple joists 12, the decking 20 comprising plural slots or openings 62 (FIG. 4) (which can be pre-punched) disposed so as to receive the portions of the angular rods 54, 58, 62 extending above the concrete surface 46. The decking 20 can be secured in place by inserting pins or wedges 66 or other suitable means between the projecting angular rod portions and the decking 20 to lock the decking in place. Where it is desired, the wedge, which can be of metal, can be welded to the rod portions or webs and to the decking 20 after being inserted between them. The projecting webs or rods 54, 58, 62 allow the poured slab 30 to form a composite with the joists 12, the anchored webs serving as shear connectors. The size of the openings 62 in the decking 20 preferably is close to the dimensions of the anchored webs to provide small tolerance therebetween, so that there is relatively little leakage of the wet concrete when it is poured. In providing the deck openings 62 it is preferred that the edges or lips 68 of the decking at the openings 62 be turned down slightly (as in FIG. 5) so that the decking better grabs the concrete joist 12.

The present invention has, in addition to the benefits over prior art means, the advantages of permitting the joists to be placed at any convenient spacing to suit the column spacings, etc. In other concrete joist systems the joists are spaced to accommodate standard width plywood sheets or fixed width plywood sheets or a fixed width form. Further, the corrugated decking used in the present invention is a permanent form and need not be removed after the poured concrete slab hardens. Also, the wedges used for securing the decking to the joists permits this to be done readily.

By rigidly anchoring the angular beam members 24 to the concrete portion of the joists 12, the joist can effectively resist horizontal and vertical shearing and bending forces at the joist end. In installing the joists 12, the bottom horizontal arms 26 of the angular beam members 24 are preferably welded to the beams 14 to serve as a composite shear connector. The preformed pans (which can be either a continuous pan having notches 70 for receiving the angular beam members 24, as in FIG. 3, or individual pans that extend only between adjacent joists, as in FIG. 2) are placed over the joist ends, and the corrugated decking is fixed over the joists, with the joist web projections protruding through the opening in the decking, and secured to the joists with the wedge means. The joist system thus is ready to receive the poured concrete. Where desired for further anchoring of the poured concrete, one or more additional stud connections 33 (FIG. 1) can be provided, for example, by welding to the beam 14.

According to another preferred embodiment of the present invention (FIG. 6 and 7, in which parts corresponding to FIG. 1 have identical numbers) the composite system 80 comprises precast concrete joists 82 disposed on a beam or girder 14, with pans 18 and corrugated decking 20. In this embodiment angular members 84 have end portions thereof 86 anchored in the concrete portions 83 of the joists 82 of which they are part, with the opposite end portions 88 of the angular members 84 protruding from the concrete portions 83. The end parts 90 of the concrete portions 83 are recessed with downwardly sloping faces 89 similar to those in FIG. 1 except that, in this embodiment, the angular members 84 (which are T-shaped, with one angular member 84 associated with each concrete end part 90, as compared with joists 12 in FIG. 1, where there are two angular elements associated with each joist end) are partly covered by concrete 91 as shown in FIGS. 6 and 7. The concrete 91 and the angular members 84 form a projection 92 from the end of the concrete portions 83 of the joists 82, which projection 92 is of rectangular or other suitable cross-sectional shape. The sloping faces 89 are located at each side of the projection 92.

In the embodiment shown in FIGS. 6 and 7, the angular members have their horizontal arms 94 down with their vertical arm 84 extending upward. The horizontal arms 94 rest on the beam 14. Also, the angular members have attached to their horizontal arms 94, anchor rods 100 that are welded to the T-shaped angle element 84. The anchor rods 100 extend downward and are encased by the concrete of the concrete portion 83 of the joist. The anchor rods 100 are the tension-carrying members. The pans 18 rest on the beam 14 and on the top surface 104 of the concrete portion, as well as on the sloping face 90. It is possible for the edges of the horizontal arms 94 to be welded to the beam 14.

In the embodiment shown in FIGS. 8 and 9, two separate methods of providing a composite system are shown. The composite system 120 includes an L-shaped, angle element 122 and has one or more studs or other projections 124 connected to one leg 126 thereof that extends downward. The angle element 122 is disposed so that its elongated axis is transverse to the longitudinal axis of the concrete portion 130 of the joist member 132. One or more second studs or other projections 134 extend upwardly from the horizontal second leg 128 of the angle element and are connected thereto. The first stud 124 is anchored in the concrete portion 130 and retains the entire angle element (with its studs 124, 134) in place on the joist. This arrangement permits the use of an unnotched continuous pan 129 that extends over several spaces between joists.

In the other arrangement shown in FIG. 8 and 9, angle element 140 comprises an L-shaped element 144 having a horizontally disposed first leg 146 and a vertically disposed second leg 148, with a generally rectangular (in profile) brace element 150 that is partly disposed in the concrete part 151 of the joist 152. The brace element 150 has one corner cut away, with the L-shaped element 144 nested in this cut out or open corner and welded to the brace element 150 that is partly disposed in the concrete part 151 of the joist 152. The angle element 140 has its elongated axis disposed generally transverse to the longitudinal axis of the concrete portion. This angle element 140 is of lesser width than the concrete portion 154 of the joist 152 (see FIG. 9). A notched pan 50 (previously described) is usable therewith with the angle element 140 being received at the notches of the pan.

Referring to FIG. 10, there is shown a further preferred embodiment of the invention, similar numbers indicating parts corresponding to the parts of the other illustrated embodiments. Here, the system 200 can comprise one or more pre-cast comcrete joists 12 and a support means such as a pre-cast concrete guide 202 that replaces the steel girder or beam 14 of FIG. 1, the respective ends of the joists 12 being disposed on the girder 200. This system 202 can also include concrete pans 18 and sheet or decking 20 and can otherwise be generally similar to the embodiment previously described.

The pre-cast concrete girder 202 preferably comprises a steel plate 204 that is cast into and forms an integral part of the girder 202. There can also be included as part of the girder 202 a stud connection 208 that has a lower portion 206 anchored in the concrete of girder 202 and an upper portion 210 extending above the concrete girder 202. Where desired, the stud connection 208 can be attached (e.g., by welding, etc.) to the steel plate 204.

According to another aspect of the preferred embodiment shown in FIG. 10, the concrete joists 12 can have one or more projecting rods 54, as previously described, and one or more of these rods 54 can have attached thereto (as by welding, etc.) one (or, if desired, two) angle members 212 located at a side of the rod 54. Where two such angle members 212 are connected to a rod 54, one angle can be located on each side of the projecting rod 54.

In the embodiment of FIGS. 10 and 11, the bearing angle member 24 of the concrete joist 12 can be welded to the steel plate 204 or the joist 12 can other wise be connected to the girder 202. The angle members 212 can be disposed so that they are in the concrete of the joist 12 with a surface thereof exposed at the top surface of the joist 12, as shown in FIG. 11, so that the angle members 212 can be used to weld the deck to the concrete joist at intervals along the joist length. It is thus possible to replace or supplement the deck attachment at the projecting webs or rods.

According to still another preferred aspect of the system 200 (FIG. 12), the concrete girder 202 comprises a continuous rod member 214 having angular portions 215 that are partly disposed within the concrete of girder 202 and project at their upper apices from the top surface 216 of the girder 202. The various angular portions 215 are connected by connecting rods 218 (which can serve as concrete-reinforcing rods), the connecting rods 218 and the angular portions 215 forming a unitary structure. Instead of the zig-zag arrangement shown in FIG. 12, other forms can be used.

I claim:

1. A precast concrete joist composite system, comprising:

(a) support means;

(b) at least first and second space apart precast concrete joist members supported at their respective ends by said support means, each of said joist members having a concrete portion, said concrete portions comprising respective end faces, said joist members comprising at their said end portions respective projecting structures that have first parts anchored in said concrete portions of their respective joist members and second parts extending from said concrete portions, said joist members including end faces, said end faces having respective portions thereof that slope downward and away from said concrete portions, said concrete portions comprising respective top surfaces; said projecting structure second part being at least partly disposed on said support means;

(c) at least a first pan element that is disposed at said end face, a first part of said pan element being disposed over said top surfaces of said concrete portions and a second part thereof disposed over said sloping portions of said end faces;

(d) a decking element disposed over the respective said top surface of said first and second joist members and spanning the space between said joist members and part of said first pan element.

2. A precast concrete joist composite system as in claim 1, wherein said decking is supported partly by said joist members.

3. The system of claim 1, wherein said first and second joist members are disposed next to each other.

4. The system of claim 1, wherein said first and second joist members are reinforced.

5. The system of claim 4, wherein said first and second joist members comprise reinforcing bars located in said concrete portions.

6. The system of claim 4, wherein said first and second joist members comprises prestressed strands located in said concrete portions.

7. The system of claim 1, wherein said support means comprises a beam member.

8. The system of claim 1, wherein at least one of structures comprises a pair of angle members that form a integral part of its associated said joists member, said angle members having an L-shaped cross section.

9. The system of claim 8, wherein said angle members are disposed with their horizontal arms down and their vertical arms extending upward, said horizontal arms being disposed on said support means.

10. The system of claim 8, wherein said horizontal arms extend in opposite directions.

11. The system of claim 8, wherein said joist members each further comprises a web element disposed between said angle members.

12. The system of claim 11, wherein said web element is generally S-shaped and has a first distal portion connected to said angle members and a second distal portion disposed within the concrete portion of its associated said joist members.

13. The system of claim 11, wherein said web element is generally 7-shaped and has a first distal portion connected to said angle members and a second distal portion disposed within the concrete portion of its associated said joist member.

14. The system of claim 1, wherein said end face of a said joist member comprises a generally vertical lower face portion comprising said downwardly sloping part of said end face.

15. The system of claim 13, wherein said end faces include a lower face disposed opposite said support means and an upper face; said upper face angularly oriented with respect to said lower face, said upper face sloping toward said support means, wherein the juncture of said upper and lower faces is in the region of said projecting structure.

16. The system of claim 1, wherein said projecting structure of a said joist member has its major axis generally parallel to the longitudinal axis of its associated joist member.

17. The system of claim 16, wherein said major axis generally coincides with the longitudinal axis of said associated joist member.

18. The system of claim 1, wherein said projecting structure has an angle element of generally T-shaped cross section and is partly covered by concrete, so that said projecting member is of generally rectangular cross-sectional shape and the bottom of said angle element is exposed.

19. The system of claim 18, wherein said angle element has its horizontal arms disposed down and its vertical arm extending upward.

20. The system of claim 19, wherein said joist member further comprises at least one anchor rod disposed at and connected to said angle element.

21. The system of claim 20, wherein said at least one anchor rod extends downward from said angle element and is encased by said concrete portion.

22. The system of claim 18, wherein said pan element comprises a third part disposed at the side of said second part remote from said first part, said third part being disposed at said angle element.

23. The system of claim 1, wherein said projecting structure comprises an angle element having a generally L-shaped cross-sectional configuration, at least one first stud projection connected to a downwardly extending first leg of said angle element, and at least one second stud projection connected to a horizontally extending second leg of said angle element, said second leg extending in the direction away from said concrete portion and said second stud projection being spaced from said concrete portion and extending upward from said second leg, said angle element having its elongated axis disposed transverse to the longitudinal axis of said concrete portion.

24. The system of claim 23, wherein said pan element comprises a third part disposed at the side of said second part remote from said first part, said third part being disposed at said angle element.

25. The system of claim 1, wherein said projecting structure comprises a brace element having a generally rectangular profile with a corner removed and further comprises an angle element being nested in the open corner of said brace element and connected thereto, said angle element comprising a horizontally disposed first leg and and a vertically disposed second leg, said concrete portion and said angle element being disposed transversely to the longitudinal axis of said concrete portion.

26. The system of claim 25, wherein said pan element comprises a third part disposed at the side of said second part remote from said first part, said third part being disposed at said angle element.

27. The system of claim 1, wherein said projecting structure is of a width less than of said concrete portion.

28. The system as in claim 1, wherein said pan element has a generally S-shaped profile.

29. The system as in claim 1, wherein said pan element comprises a third part, said second part being located between and connecting said first and third parts thereof, said third part being disposed at least partly above said projecting structure.

30. The system of claim 29, wherein said first and third parts of said pan element are generally parallel.

31. The system of claim 30, wherein said second part is obliquely disposed with respect to said first and third parts.

32. The system of claim 1, further comprising means for connecting said pan elements to said support means.

33. The system as in claim 1, further comprising means for connecting said pan element and said decking element.

34. The system of claim 1, wherein said joist members comprise composite projecting rod members extending from the respective upper surfaces of said concrete portions thereof and having their lower extremities anchored in said concrete portion.

35. The system of claim 34, wherein said rod members comprise plural separate segments disposed in spaced apart relationship along the length of said joist member.

36. The system of claim 35, wherein said rod member segments are joined together by a connecting rod located within said concrete portions.

37. The system of claim 1, wherein said rod members comprises respective continuous elements each having an angular portion partly disposed within said concrete portion and having apices projecting from the top surface of said concrete portion.

38. The system of claim 37, wherein said rod member comprises plural angular parts having their respective apices extending above top surfaces of said concrete portion and lower portions disposed within said concrete portion, said lower portions being connected together by intermediate connecting parts, said angular parts and said connecting parts comprising a unitary structure.

39. The system of claim 34, wherein said decking comprises at least one opening extending therethrough for receiving parts of said rod members extending above said surface of said concrete portion.

40. The system of claim 39, further comprising means that can be inserted between said extending parts of said rod members and said decking, to retain said decking in place with respect to said joist members.

41. A precast concrete joist for a composite structural system comprising an elongated concrete portion having a first end face and a projecting structure located at said end face, said projecting structure having a first part anchored in said end face, said projecting structure having a first part anchored in said concrete portion and a second part extending from said end face, said end face having an inclined portion that extends down and away from said concrete portion, said concrete portion comprising a top surface, said joist further comprising at least one rod member having a first angular portion extending from said top surface and a second portion anchored in said concrete portion, said inclined portion and top surface being adjusted to receive portions of a pan element used with said joist and said first angular portions of said rod member being adapted to be received in an opening of decking used with said joist, and said projecting structure being adapted to be disposed on a supporting structure.

* * * * *